US009429897B2

(12) United States Patent
Yuan et al.

(10) Patent No.: US 9,429,897 B2
(45) Date of Patent: Aug. 30, 2016

(54) IMAGE FORMING APPARATUS

(71) Applicant: FUJI XEROX CO., LTD., Tokyo (JP)

(72) Inventors: Lei Yuan, Kanagawa (JP); Kazuaki Iikura, Kanagawa (JP); Kaoru Watanabe, Kanagawa (JP); Kazuhiro Saito, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 2 days.

(21) Appl. No.: 14/717,452

(22) Filed: May 20, 2015

(65) Prior Publication Data

US 2016/0098008 A1 Apr. 7, 2016

(30) Foreign Application Priority Data

Oct. 7, 2014 (JP) ..... 2014-206277

(51) Int. Cl.
*G03G 21/16* (2006.01)

(52) U.S. Cl.
CPC ..... *G03G 21/1647* (2013.01)

(58) Field of Classification Search
USPC ..... 399/167
See application file for complete search history.

(56) References Cited

U.S. PATENT DOCUMENTS 8,086,135 B2 * 12/2011 Hashimoto ..... G03G 21/186 399/111
8,254,805 B2 8/2012 Mizuno et al.
2002/0172531 A1 * 11/2002 Harada ..... G03G 15/757 399/167
2007/0003321 A1 * 1/2007 Hara ..... G03G 15/757 399/167
2009/0317132 A1 * 12/2009 Asanuma ..... G03G 21/1853 399/117
2015/0053032 A1 * 2/2015 Yamazaki ..... G03G 15/00 74/412 R

FOREIGN PATENT DOCUMENTS

JP 2008-310292 A 12/2008
JP 2012-137794 A 7/2012

* cited by examiner

*Primary Examiner* — Rochelle-Ann J Blackman
*Assistant Examiner* — Linda B Smith
(74) *Attorney, Agent, or Firm* — Oliff PLC

(57) ABSTRACT

An image forming apparatus includes an image carrier that is rotatably supported, a to-be-transferred member onto which an image that is held by the image carrier is transferred, a driving unit that is disposed on a first end portion of the image carrier in an axial direction of the image carrier and that causes the image carrier to rotate, and a retreat mechanism that causes a second end portion of the image carrier to be separated from the to-be-transferred member while a connection between the image carrier and the driving unit is maintained and thereafter causes the image carrier to retreat by disconnecting the image carrier and the driving unit from each other.

6 Claims, 6 Drawing Sheets

IMAGE FORMING APPARATUS

CROSS-REFERENCE TO RELATED APPLICATIONS

This application is based on and claims priority under 35 USC 119 from Japanese Patent Application No. 2014-206277 filed Oct. 7, 2014.

BACKGROUND

Technical Field

The present invention relates to an image forming apparatus.

SUMMARY

According to an aspect of the invention, there is provided an image forming apparatus including an image carrier that is rotatably supported, a to-be-transferred member onto which an image that is held by the image carrier is transferred, a driving unit that is disposed on a first end portion of the image carrier in an axial direction of the image carrier and that causes the image carrier to rotate, and a retreat mechanism that causes a second end portion of the image carrier to be separated from the to-be-transferred member while a connection between the image carrier and the driving unit is maintained and thereafter causes the image carrier to retreat by disconnecting the image carrier and the driving unit from each other.

BRIEF DESCRIPTION OF THE DRAWINGS

An exemplary embodiment of the present invention will be described in detail based on the following figures, wherein.

DETAILED DESCRIPTION

Figure 1:
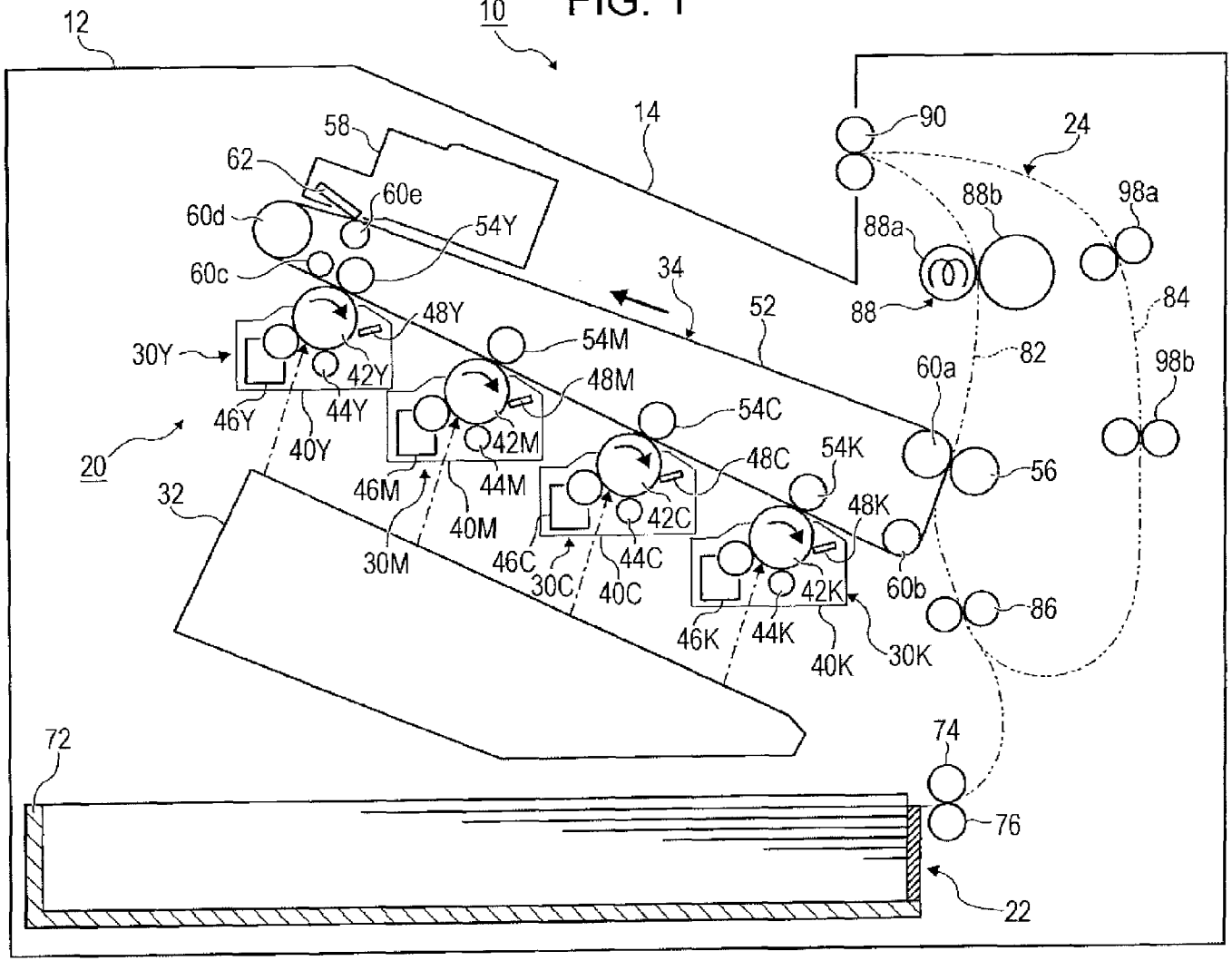
FIG. 1 is a sectional side view of an image forming apparatus according to an exemplary embodiment.

An exemplary embodiment of the present invention will be described below with reference to the drawings. However, in the exemplary embodiment, an image forming apparatus is descried as an example for implementing the technical concept of the present invention, and the present invention is not intended to be limited to the exemplary embodiment. The present invention is equally applicable to other exemplary embodiments within the scope of the claims.

Exemplary Embodiment

An image forming apparatus 10 according to an exemplary embodiment of the present invention, the image forming apparatus 10 including a retreat mechanism 109 for a process cartridge 30, will be described with reference to FIG. 1 to FIG. 6C.

The image forming apparatus 10 includes an image forming apparatus body 12, and an ejection part 14 is formed in a top surface of the image forming apparatus body 12. A recording medium on which an image has been formed is to be ejected to the ejection part 14.

Figure 2:
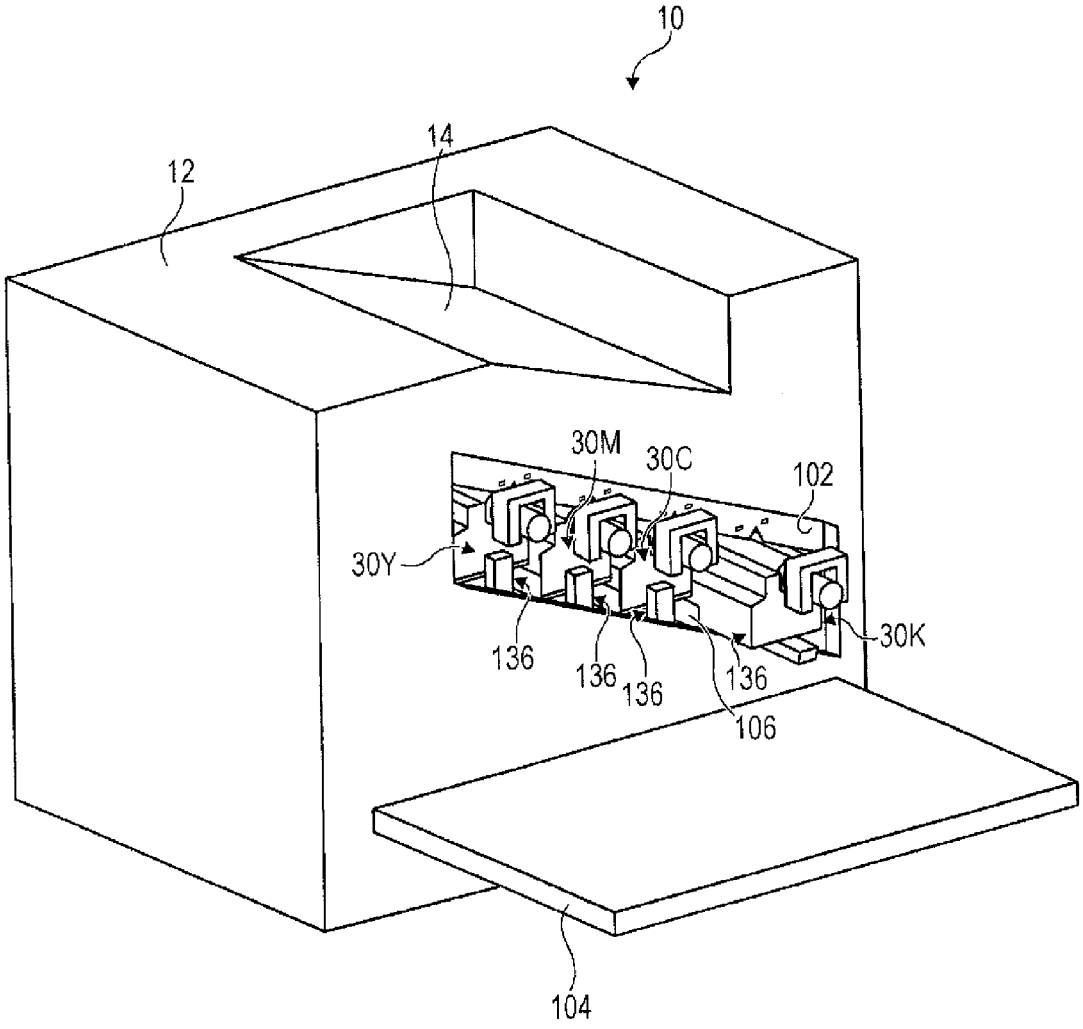
FIG. 2 is a perspective view illustrating a state where an opening and closing portion of the image forming apparatus according to the exemplary embodiment is open.

As illustrated in FIG. 2, an opening 102 through which the process cartridge 30, which will be described later, is to be mounted on and removed from the image forming apparatus body 12 is formed in one of side surfaces of the image forming apparatus body 12, and an opening and closing portion 104 is formed in the one of side surfaces of the image forming apparatus body 12 so as to be capable of being opened and closed with respect to the image forming apparatus body 12 and allowing the opening 102 to be exposed or covered by the opening and closing portion 104. The opening 102 is used as an area where an insertion operation is performed, and the process cartridge 30 is mounted by being inserted into the image forming apparatus body 12 from the opening 102. The image forming apparatus 10 according to the exemplary embodiment is provided with the retreat mechanism 109 that causes the process cartridge 30 to retreat.

The retreat mechanism 109 is a mechanism that causes the process cartridge 30 to retreat from the image forming apparatus body 12. The retreat mechanism 109 is configured to change the position of the process cartridge 30 between a mounting position where the process cartridge 30 is located when the process cartridge 30 is in a state of being mounted in the image forming apparatus body 12 and a retreat position where the process cartridge 30 is located when the process cartridge 30 is removed from the image forming apparatus body 12, and the position of the process cartridge 30 is changed from the mounting position to the retreat position by changing only the position of a portion of the process cartridge 30 on one side. Note that the retreat mechanism 109 according to the exemplary embodiment is formed of a raising and lowering unit 136 that is attached to the process cartridge 30, which will be described later, a to-be-connected portion 122 of a photoconductor 42, and a connecting portion 112 included in a driving unit 110 that is attached to the image forming apparatus body 12 (see FIGS. 3A to 3C and FIGS. 6A to 6C).

An image forming unit 20 that forms an image, which is transferred onto a recording medium, a recording-media feeder 22 that feeds a recording medium to the image forming unit 20, and a transport path 24 along which a recording medium, which is fed from the recording-media feeder 22, is transported to the ejection part 14 are disposed in the image forming apparatus body 12. In addition, a guiding portion 106 is disposed in the image forming apparatus body 12, and the guiding portion 106 guides the process cartridge 30, which is to be inserted into and removed from the image forming apparatus body 12 so as to be mounted on and removed from the image forming apparatus body 12.

Figure 3A:
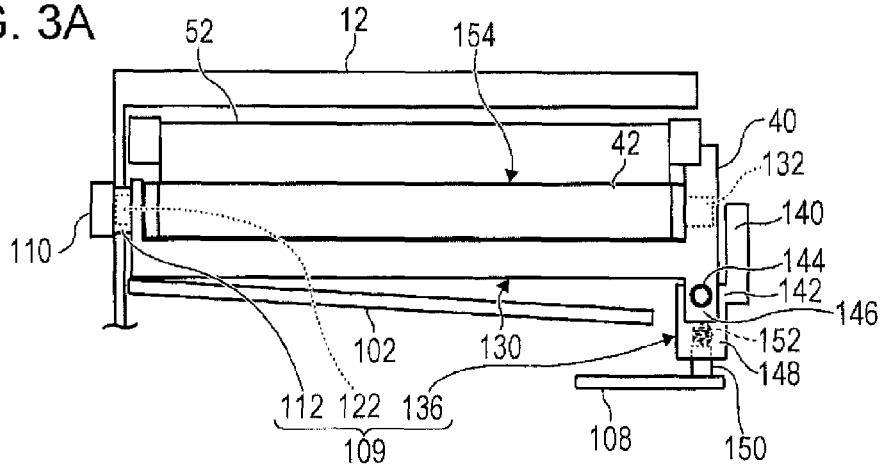
FIG. 3A is a front view illustrating a mounting position where a process cartridge is in a state of being mounted in an image forming apparatus body.

When the process cartridge 30 is mounted in the image forming apparatus body 12, the process cartridge 30 is supported by the raising and lowering unit 136, which is attached to the process cartridge 30 (see FIG. 3A). In this state, in the image forming apparatus body 12, a portion where the raising and lowering unit 136 is positioned serves as a support portion 108.

The image forming unit 20 includes, for example, process cartridges 30Y, 30M, 30C, and 30K that correspond to four colors of yellow (Y), magenta (M), cyan (C), and black (K), respectively, an optical writing device 32, and a transfer device 34. The configurations of the process cartridges 30Y, 30M, 30C, and 30K including their components are similar to one another except for colors of images formed by the process cartridges 30Y, 30M, 30C, and 30K. In the following description, the suffixes Y, M, C, and K may sometimes be omitted when it is not necessary to distinguish the process cartridges 30Y, 30M, 30C, and 30K and their components in accordance with the colors, and the process cartridges 30Y, 30M, 30C, and 30K may sometimes be collectively called, for example, "process cartridges 30".

Each of the process cartridges 30 is used as a replaceable member and disposed so as to be capable of being mounted on and removed from the image forming apparatus body 12. The process cartridges 30Y, 30M, 30C, and 30K are disposed in this order starting from the rear side (the left side in FIG. 1) of the image forming apparatus body 12.

Each of the process cartridges 30 is, for example, a device that employs an electrophotographic system and forms a color image. Each of the process cartridges 30 includes a process cartridge body 40. In the process cartridge body 40, the photoconductor 42 that serves as a drum-shaped image carrier, which carries a developer image, a charging device 44 that serves as a charging unit, which includes a charging roller that uniformly charges the photoconductor 42, a developing unit 46 that develops a latent image, which has been written on the photoconductor 42, with a developer (toner), and a cleaning device 48 that cleans the photoconductor 42 by, for example, scraping off waste developer remaining on the photoconductor 42 are disposed.

In order to cause the photoconductors 42 to rotate, the to-be-connected portions 122 that are configured to transmit the power of the driving units 110 and that are to be connected to the connecting portions 112, which are included in the driving units 110, are formed at first ends of the photoconductors 42. Note that, in the exemplary embodiment, the to-be-connected portions 122 are formed in portions of the process cartridges 30 that are to be inserted into the image forming apparatus body 12.

Figure 5A:
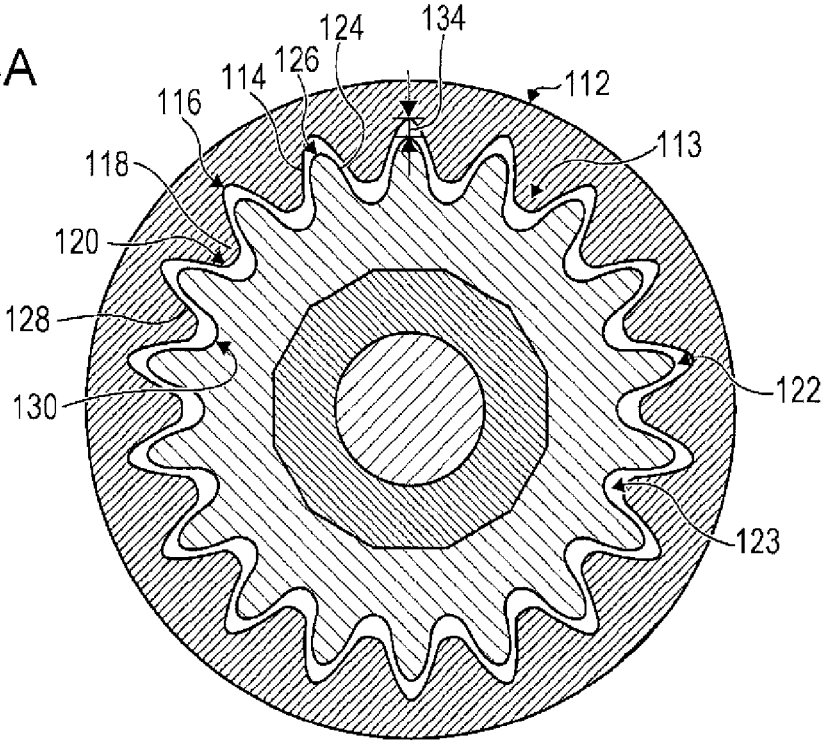
FIG. 5A is a cross-sectional view taken along line VA-VA of FIG. 4A.
Figure 5B:
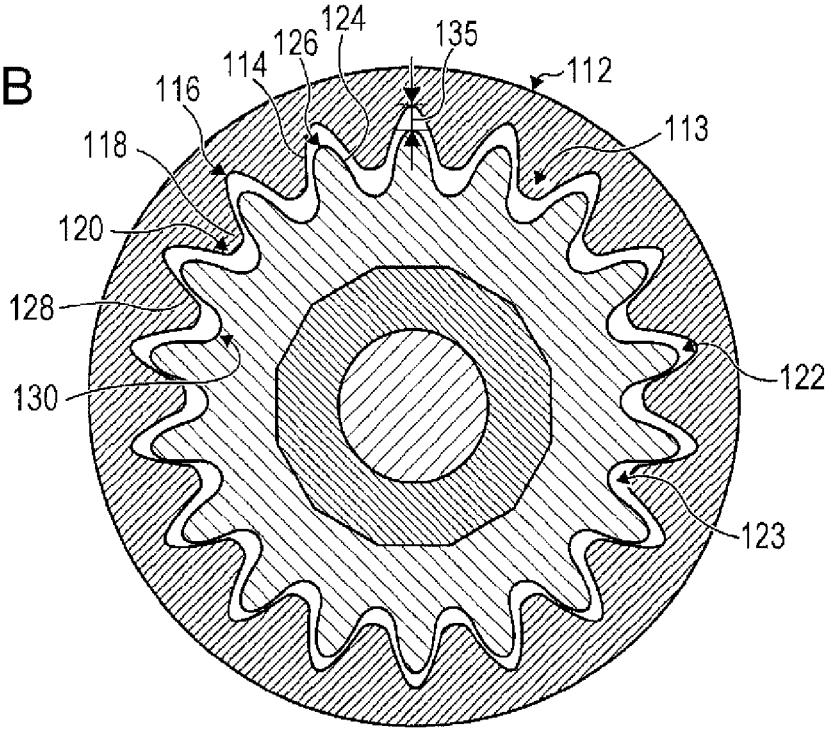
FIG. 5B is a cross-sectional view taken along line VB-VB of FIG. 4B.

Gear portions 123 each having a cylindrical shape are formed in the to-be-connected portions 122, which are formed at the first ends of the photoconductors 42, and each of the gear portions 123 has plural first protrusions 124 protruding in an outward radial direction with respect to the axial direction of the corresponding photoconductor 42 (see FIGS. 5A and 5B). Note that second ends of the photoconductors 42 on the opposite side to the to-be-connected portions 122 serve as non-driving units 132 that extend from the second ends of the photoconductors 42, and the non-driving units 132 are not connected to driving power sources such as the driving units 110. Portions of the to-be-connected portions 122 of the photoconductors 42 of the process cartridges 30 and the non-driving units 132 each have a rotatable shape, for example, a columnar shape, and are rotatably attached to the corresponding process cartridge bodies 40.

In the image forming apparatus body 12, the connecting portions 112 to which the to-be-connected portions 122 of the photoconductors 42 are to be connected are formed on the distal side in the direction in which the process cartridges 30 are inserted into the image forming apparatus body 12. The connecting portions 112 are formed in such a manner that the gear portions 123 of the to-be-connected portions 122 of the photoconductors 42 are fitted into the corresponding connecting portions 112 in the axial direction of the connecting portions 112. In each of the connecting portions 112, an internal gear portion 113 that has a cylindrical shape and has plural second grooves 114 formed in an inward radial direction with respect to the axial direction of the connecting portion 112 is formed, and the first protrusions 124 of the gear portion 123 of each of the to-be-connected portions 122 are to be fitted into the plural second grooves 114 of the corresponding connecting portion 112. In addition, the connecting portions 112 are connected to the corresponding driving units 110. Each of the connecting portions 112 rotates with rotation of the corresponding driving unit 110, and each of the photoconductors 42 that include the to-be-connected portions 122 rotates with rotation of the corresponding connecting portion 112.

The gear portions 123 of the to-be-connected portions 122 and the internal gear portions 113 of the connecting portions 112 are each sized to form gaps between the internal gear portions 113 and the corresponding gear portions 123 when the gear portions 123 and the corresponding internal gear portions 113 are connected to each other. These gaps include gaps that are required when the gear portions 123 of the to-be-connected portions 122 are fitted into the corresponding internal gear portions 113 of the connecting portions 112 and gaps 134 that are formed between, when the process cartridges 30 are mounted in the image forming apparatus body 12, first peak portions 126 of the first protrusions 124 of the gear portions 123 of the to-be-connected portions 122 and second valley portions 116 of the second grooves 114 of the internal gear portions 113 of the corresponding connecting portions 112 into which the first peak portions 126 are to be fitted and between first valley portions 130 of first grooves 128 of the gear portions 123 of the to-be-connected portions 122 and second peak portions 120 of second protrusions 118 of the internal gear portions 113 of the corresponding connecting portions 112 into which the first valley portions 130 are to be fitted (see FIG. 5A).

The raising and lowering units 136 are attached to the process cartridges 30 on the side on which the non-driving units 132 are present, and each of the raising and lowering units 136 changes the position of the corresponding process cartridge 30 in order to allow the process cartridge 30 to be mounted on and removed from the image forming apparatus body 12. Operating each of the raising and lowering units 136 causes the position of the corresponding process cartridge 30 to change between a mounting position 154 and a retreat position 156 (see FIGS. 3A to 3C). The process cartridge 30 is located at the mounting position 154 when the process cartridge 30 is in a state of being mounted in the image forming apparatus body 12 and is located at the retreat position 156 when the process cartridge 30 is mounted onto and removed from the image forming apparatus body 12.

Note that, in the exemplary embodiment, the mounting position 154 is a position where one of the process cartridges 30 is located when the process cartridge 30 is in a state of being mounted in the image forming apparatus body 12 and when the photoconductor 42 of the process cartridge 30 and a belt-shaped member 52, which is disposed in the image forming apparatus body 12 and onto which a developer image is transferred, are in contact with each other. The belt-shaped member 52 will hereinafter be referred to as to-be-transferred member 52. On the other hand, the retreat position 156 is a position where one of the process cartridges 30 is located when the position of a portion of the process cartridge 30 on the side on which the non-driving unit 132 is present is changed to a different position, for example, a position lower than the mounting position 154, while maintaining the connection between the to-be-connected portion 122 of the photoconductor 42 and the corresponding connecting portion 112 of the image forming apparatus 10 in order to remove the process cartridge 30 from the image forming apparatus body 12.

Each of the raising and lowering units 136 is mounted on the bottom surface side of the non-driving unit 132 of the corresponding process cartridge 30 in such a manner as to be capable of performing a repetitive motion. Each of the raising and lowering units 136 includes an operation portion 140 that is to be operated by a user who applies a force to the operation portion 140 and a column portion 148 that is formed at one end of the operation portion 140 and disposed between the bottom surface side of the non-driving unit 132 of the corresponding process cartridge 30 and a corresponding one of the support portions 108 in such a manner as to support the process cartridge 30. The column portion 148 includes, on the side on which the bottom surface of the corresponding process cartridge body 40 is present, a projecting portion 146 projecting from the bottom surface of the corresponding process cartridge body 40 and a connecting portion 142 that is arranged so as to be capable of performing a repetitive motion, and the projecting portion 146 and the connecting portion 142 are attached to the column portion 148 with a shaft portion 144 that is capable of performing a repetitive motion.

Each of the column portions 148 includes a column end portion 150 that is in contact with the corresponding support portion 108 of the image forming apparatus body 12. The column end portion 150 is attached to, for example, a spring member 152 that is disposed in the column portion 148 and that has elasticity, so that a pressing force between the column end portion 150 and the corresponding process cartridge 30 and a pressing force that is applied to the photoconductor 42 of the process cartridge 30 against the to-be-transferred member 52 of the image forming apparatus body 12 are adjusted.

Thus, operating each of the raising and lowering units 136 causes the position of a portion of the corresponding process cartridge 30 on the side on which the non-driving unit 132 is present to change between the mounting position 154, where the process cartridge 30 is located when the process cartridge 30 is in a state of being mounted in the image forming apparatus body 12, and the retreat position 156, to which the process cartridge 30 is retreated in order to be mounted onto and removed from the image forming apparatus body 12.

The developing units 46 develop latent images, which are formed on the corresponding photoconductors 42, with corresponding developers of Y, M, C, and K contained therein.

The optical writing device 32 is used as a latent-image-forming device and radiates light onto the photoconductors 42 in such a manner as to form latent images on surfaces of the photoconductors 42.

The transfer device 34 includes the to-be-transferred member 52, which is used as a transfer member, first transfer rollers 54Y, 54M, 54C, and 54K, each of which is used as a first transfer device, a second transfer roller 56, which is used as a second transfer device, and a cleaning device 58.

The to-be-transferred member 52 is in the form of, for example, an endless belt and is supported by five support rollers 60*a*, 60*b*, 60*c*, 60*d*, and 60*e* in such a manner as to be rotatable in a direction indicated by an arrow in FIG. 1. At least one of the support rollers 60*a*, 60*b*, 60*c*, 60*d*, and 60*e* is coupled to a power source (not illustrated) such as a motor and rotates as a result of receiving a driving force of the power source, so that the to-be-transferred member 52 is driven so as to rotate. Note that in the case where the process cartridges 30 are mounted in the image forming apparatus body 12, the photoconductors 42 of the process cartridges 30 and the to-be-transferred member 52 are in contact with each other (see FIG. 3A).

The support roller 60*a* is disposed in such a manner as to face the second transfer roller 56 and functions as a backup roller of the second transfer roller 56. A nip part defined by the second transfer roller 56 and the support roller 60*a* serves as a second transfer position.

Each of the first transfer rollers 54 transfers a corresponding one of developer images, which have been formed on the surfaces of the photoconductors 42 by the developing units 46, onto the to-be-transferred member 52.

The second transfer roller 56 transfers developer images of Y, M, C, and K, which have been transferred to the to-be-transferred member 52, onto one of recording media.

The cleaning device 58 includes a scraper 62 that scrapes off the developers of the different colors remaining on a surface of the to-be-transferred member 52 after the developer images of the different colors have been transferred to the recording medium by the second transfer roller 56. The developers that are scraped off by the scraper 62 are collected in a body of the cleaning device 58.

The recording-media feeder 22 includes a recording-media container 72 in which recording media are accommodated in such a manner as to be stacked on top of one another, a transport roller 74 that extracts one of the recording media, which are accommodated in the recording-media container 72, the recording medium to be extracted being at the top of the stacked recording media, and transports the extracted recording medium toward the image forming unit 20, and a retard roller 76 that separates the recording media one by one and prevents the plural recording media from being transported to the image forming unit 20 while superposed with each other.

The transport path 24 is formed of a transport path 82 and a reverse transport path 84.

The transport path 82 is a transport path along which one of the recording media fed from the recording-media feeder 22 is transported to the image forming unit 20 and along which the recording medium, on which an image has been formed, is ejected to the ejection part 14. The transport roller 74, the retard roller 76, registration rollers 86, the transfer device 34, a fixing device 88, and ejection rollers 90 are disposed along the transport path 82 in this order starting from an upstream side in the direction in which the recording media is to be transported.

The registration rollers 86 cause a leading end of one of the recording media transported by the recording-media feeder 22 to be temporarily stationary and then sends out the recording medium toward the transfer device 34 in accordance with the timing at which image formation is performed.

The fixing device 88 includes a heating roller 88*a* and a pressure roller 88*b* and fixes developer images onto one of the recording media that passes between the heating roller 88*a* and the pressure roller 88*b* by heating the recording medium and applying pressure to the recording medium.

The ejection rollers 90 eject the recording medium, to which the developer images have been fixed by the fixing device 88, to the ejection part 14.

The reverse transport path 84 is a transport path used for inverting the front and rear surfaces of a recording medium, the recording medium having developer images formed on one of the front and rear surfaces thereof, and for returning the recording medium toward the image forming unit 20. For example, a pair of reverse-transport rollers 98*a* and a pair of reverse-transport rollers 98*b* are disposed along the reverse transport path 84.

One of the recording media is transported to the position where the ejection rollers 90 are disposed along the transport path 82, and the ejection rollers 90 rotate in a reverse direction in a state where a trailing end portion of the recording medium is nipped by the ejection rollers 90, so that the recording medium is fed to the reverse transport path 84. The recording medium, which has been fed to the reverse transport path 84, is transported to a position upstream of the registration rollers 86 by the pairs of transport rollers 98*a* and 98*b*.

Mounting and removing the process cartridges 30 onto and from the image forming apparatus body 12 will now be described.

First, the case of removing one of the process cartridges 30 from the image forming apparatus body 12 will be described. When the process cartridge 30 that has been mounted in the image forming apparatus 10 is removed, first, the opening and closing portion 104, which is formed in a side surface of the image forming apparatus body 12, is opened in such a manner as to expose the process cartridge 30 through the opening 102 (see FIG. 2).

Figure 3B:
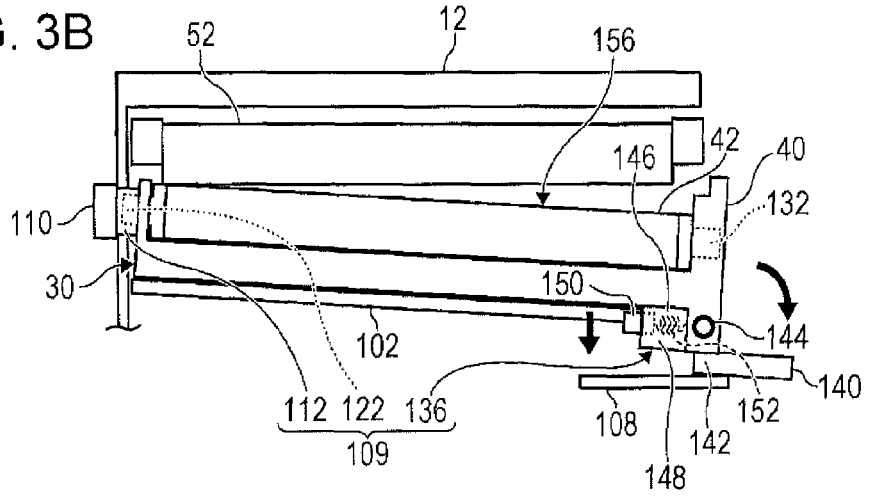
FIG. 3B is a front view illustrating a state where the process cartridge is located at a retreat position.

Next, as illustrated in FIG. 3A and FIG. 3B, the raising and lowering unit 136, which is attached to the process cartridge 30 and which forms part of the corresponding retreat mechanism 109, is operated in such a manner as to change the position of the process cartridge 30 from the mounting position 154 to the retreat position 156. This operation is performed by, first, lowering the operation portion 140 of the raising and lowering unit 136, which faces upward, toward the side on which the opening 102 is present by applying a force to the operation portion 140 in such a manner as to cause the operation portion 140 to be horizontally placed. In this case, the operation portion 140 is rotated around the shaft portion 144.

By moving the operation portion 140, the column portion 148, which is formed on the lower side of the connecting portion 142, also rotates around the shaft portion 144. As a result of the rotation of the column portion 148, the column end portion 150 of the column portion 148 slides over the support portion 108 of the image forming apparatus body 12, and the column portion 148 is moved to a position where the column portion 148 is in contact with the bottom surface of the process cartridge body 40.

As a result of the column portion 148 moving as described above, the process cartridge 30 is in a state of not being supported by the column portion 148, and a portion of the process cartridge 30 on the side on which the non-driving unit 132 is present moves downward. This downward movement of the process cartridge 30 stops when the bottom surface of the process cartridge 30 reaches the corresponding guiding portion 106. In addition, the spring member 152, which is disposed in the column portion 148, expands by releasing its elastic energy.

Figure 4A:
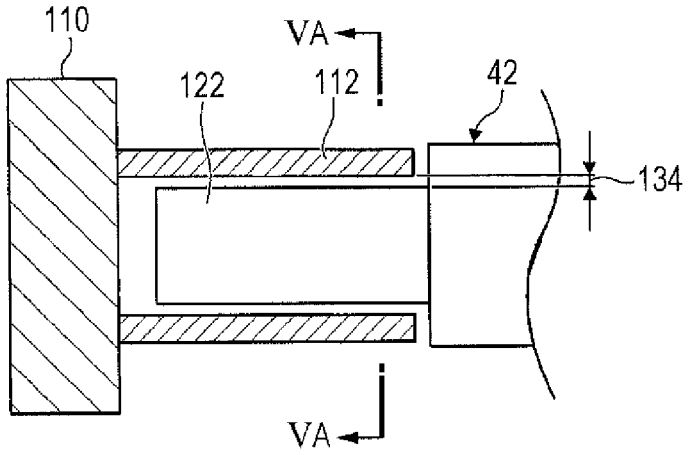
FIG. 4A is a sectional view illustrating a connecting portion and a to-be-connected portion in a state where the process cartridge is located at the mounting position.
Figure 4B:
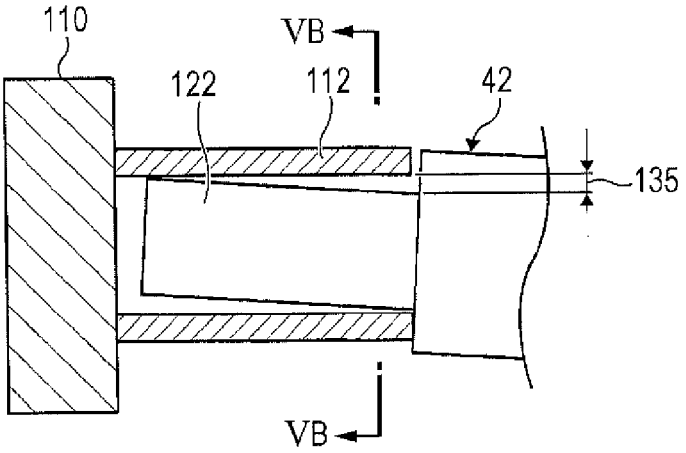
FIG. 4B is a sectional view illustrating the connecting portion and the to-be-connected portion in a state where the process cartridge is located at the retreat position.
Figure 4C:
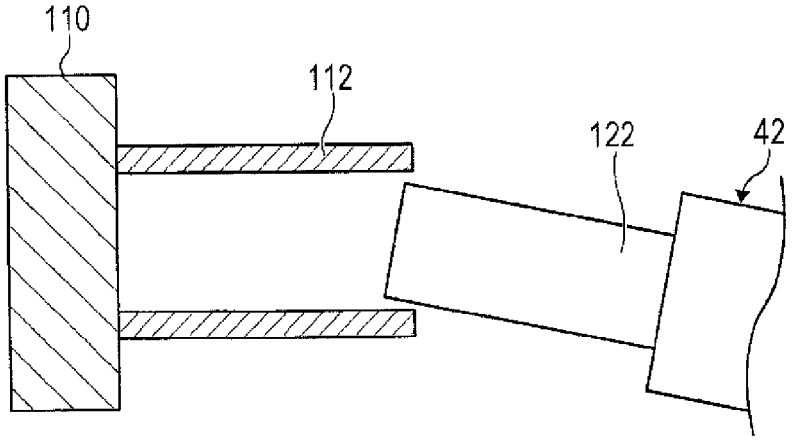
FIG. 4C is a sectional view illustrating the connecting portion and the to-be-connected portion in a state where the process cartridge is removed from the image forming apparatus body.

As illustrated in FIG. 4A and FIG. 4B, when the process cartridge 30 is moved to the retreat position 156, although the portion of the process cartridge 30 on the side on which the non-driving unit 132 is present moves downward, the connection between the to-be-connected portion 122 and the connecting portion 112 is maintained. In this case, as illustrated in FIG. 5A and FIG. 5B, the gear portion 123 of the to-be-connected portion 122 and the internal gear portion 113 of the corresponding connecting portion 112 are connected to each other with the gaps 134, which are formed when the process cartridge 30 is mounted in the image forming apparatus body 12, formed therebetween. Thus, when the process cartridge 30 is inclined, gaps 135, which are required for the to-be-connected portion 122 to be inclined in the connecting portion 112 and which are formed when the process cartridge 30 is retreated, are formed between the first peak portions 126 of the first protrusions 124 of the gear portion 123 of the to-be-connected portion 122 and the second valley portions 116 of the second grooves 114 of the internal gear portion 113 of the connecting portion 112 into which the first peak portions 126 are to be fitted and between the first valley portions 130 of the first grooves 128 of the gear portion 123 of the to-be-connected portion 122 and the second peak portions 120 of the second protrusions 118 of the internal gear portion 113 of the connecting portion 112 into which the first valley portions 130 are to be fitted.

When the process cartridge 30 is obliquely disposed as a result of the portion of the process cartridge 30 on the side on which the non-driving unit 132 is present moving downward, the process cartridge 30 is located at the retreat position 156, which is the position where the process cartridge 30 is to be located when the process cartridge 30 is mounted onto and removed from the image forming apparatus body 12. As a result of the process cartridge 30 moving to the retreat position 156, the photoconductor 42 of the process cartridge 30 and the to-be-transferred member 52 of the image forming apparatus body 12 are disconnected from each other.

Figure 3C:
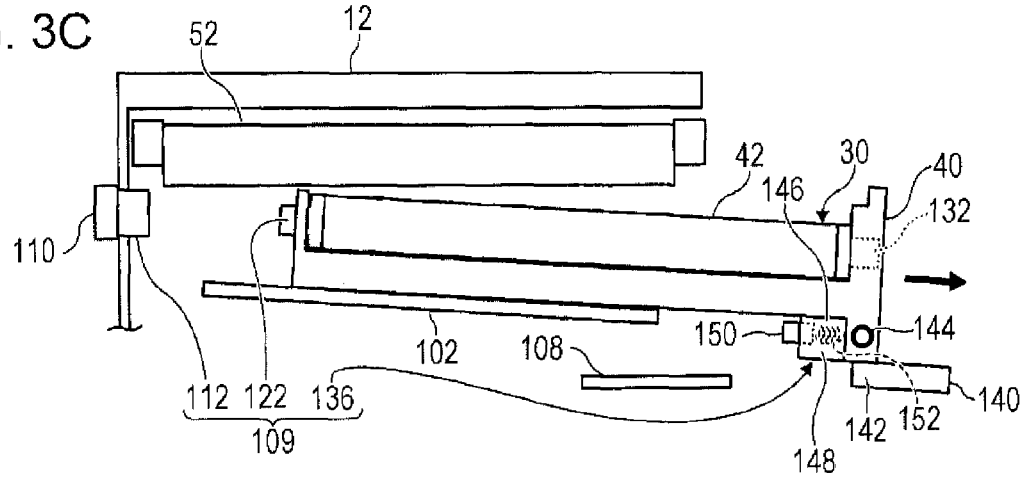
FIG. 3C is a front view illustrating a state where the process cartridge is removed from the image forming apparatus body.

After that, as illustrated in FIG. 3C, the process cartridge 30 at the retreat position 156 is pulled out obliquely, so that the connecting portion 112 and the to-be-connected portion 122 are disconnected from each other (see FIG. 4C), and the process cartridge 30 is removed from the image forming apparatus body 12 through the process cartridges 30. Note that, in this case, the process cartridge 30 is pulled out along the guiding portion 106 that is inclined in such a manner as to correspond to the retreat position 156 of the process cartridge 30, so that the process cartridge 30 may be smoothly removed from the image forming apparatus body 12 through the process cartridges 30.

The case where one of the process cartridges 30 is mounted onto the image forming apparatus body 12 will now be described. The mounting operation of the process cartridge 30 is started in the above-described state where the process cartridge 30 has been removed from the image forming apparatus body 12 through the opening 102.

Figure 6A:
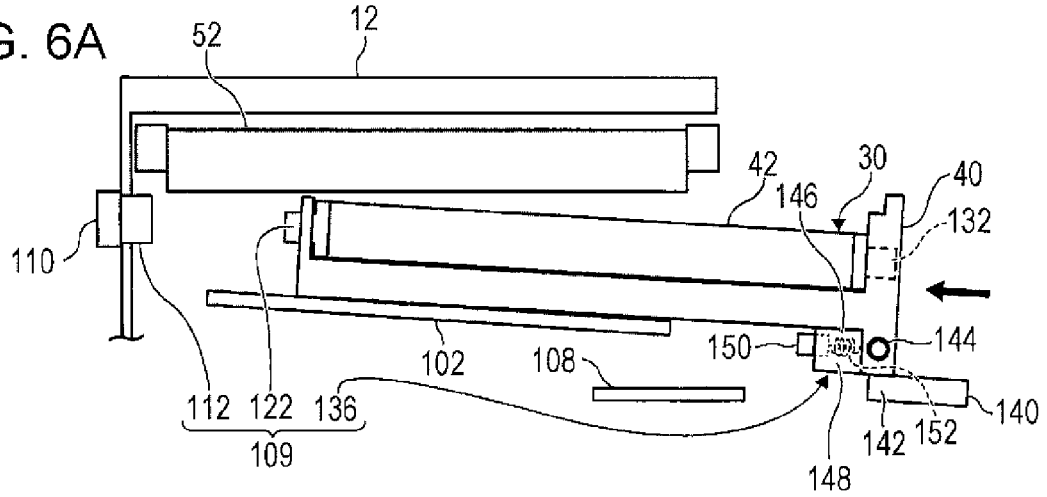
FIG. 6A is a front view illustrating a state where the process cartridge is inserted into the image forming apparatus body.
Figure 6B:
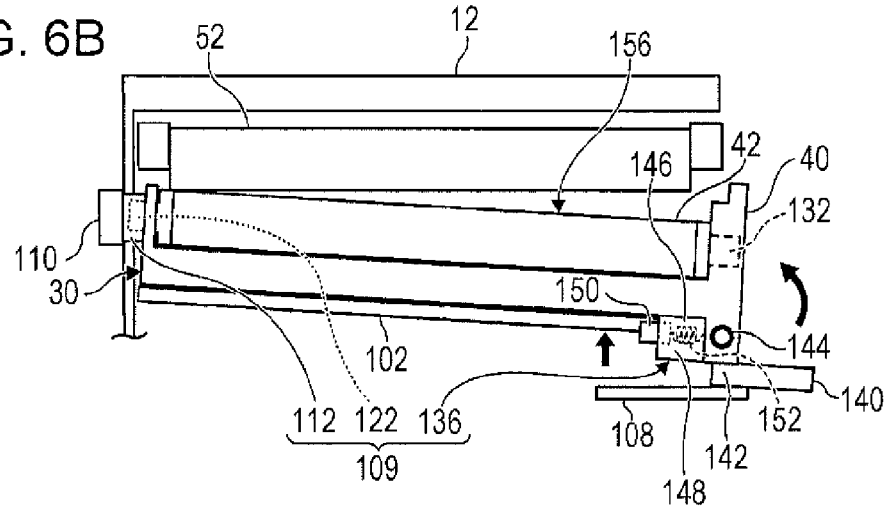
FIG. 6B is a sectional view illustrating a state where the process cartridge is located at the retreat position.

First, as illustrated in FIG. 6A and FIG. 6B, the process cartridge 30 is inserted obliquely through the opening 102 of the image forming apparatus body 12 in such a manner as to be located at the retreat position 156. This insertion operation is performed by using the guiding portion 106 that is obliquely disposed with respect to the opening 102. Regarding the raising and lowering unit 136, which is attached to the process cartridge 30, the operation portion 140 and the column portion 148 are in a state of being horizontally placed, that is, the column portion 148 is in contact with the bottom surface of the process cartridge body 40.

When the process cartridge 30 is inserted into the image forming apparatus body 12, the connecting portion 112 of the image forming apparatus body 12 and the to-be-connected portion 122 of the photoconductor 42 of the process cartridge 30 are fitted to each other. The connecting portion 112 and the to-be-connected portion 122 are fitted to each other by inserting the to-be-connected portion 122 into the connecting portion 112 in an oblique direction (see FIG. 4C). In this case, as described above, gaps are formed between the gear portion 123 of the to-be-connected portion 122 and the internal gear portion 113 of the connecting portion 112 as illustrated in FIG. 5A and FIG. 5B, the gaps including the gaps 135 that are formed, when the process cartridge 30 is retreated, between the first peak portions 126 of the first protrusions 124 of the gear portion 123 of the to-be-connected portion 122 and the second valley portions 116 of the second grooves 114 of the internal gear portion 113 of the connecting portion 112 into which the first peak portions 126 are to be fitted and between the first valley portions 130 of first grooves 128 of the gear portion 123 of the to-be-connected portion 122 and the second peak portions 120 of second protrusions 118 of the internal gear portion 113 of the connecting portions 112 into which the first valley portions 130 are to be fitted.

Figure 6C:
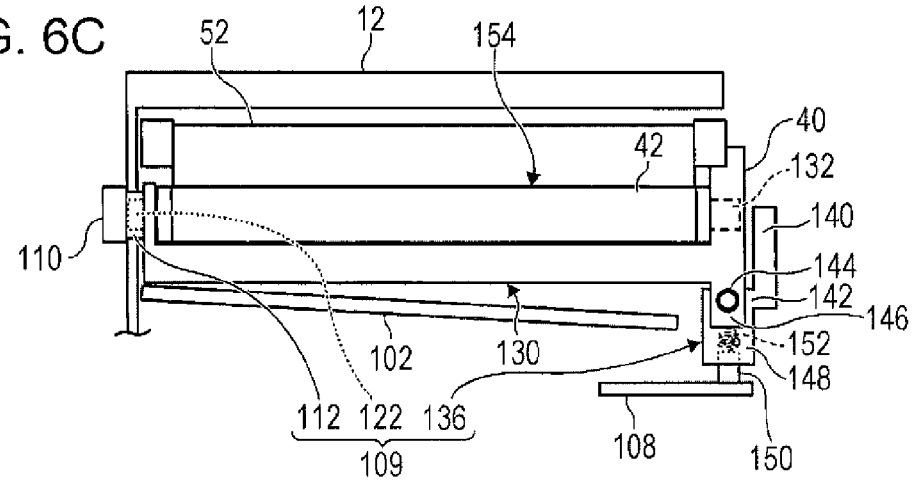
FIG. 6C is a front view illustrating a state where the process cartridge is mounted in the image forming apparatus body and located at the mounting position.

Next, as illustrated in FIG. 6B and FIG. 6C, the raising and lowering unit 136 of the process cartridge 30, which has been received by the image forming apparatus body 12, is operated in such a manner as to change the position of the process cartridge 30 from the retreat position 156 to the mounting position 154. In this operation, a force is applied to the operation portion 140 of the raising and lowering unit 136, and the operation portion 140 is moved in a direction in which the position of the operation portion 140 is changed from a horizontally-placed position to a vertically-placed position. In this case, the operation portion 140 is rotated around the shaft portion 144.

Upon the rotation the operation portion 140, the column portion 148, which is formed on the lower side of the connecting portion 142, also rotates around the shaft portion 144, and the position of the column portion 148 is changed from a horizontally-placed position to a vertically-placed position. As a result of the rotation of the column portion 148, the column end portion 150 slides over the support portion 108 of the image forming apparatus body 12, and the position of the column portion 148 is changed to the vertically-placed position, so that the process cartridge 30 is moved upward.

As a result of the column portion 148 being moved to a predetermined position, the process cartridge 30 is located at the mounting position 154 and mounted in the image forming apparatus body 12. In this case, the process cartridge 30 is mounted in the image forming apparatus body 12, so that the photoconductor 42 of the process cartridge 30 and the to-be-transferred member 52 of the image forming apparatus body 12 are in contact with each other. In addition, the gaps formed between the connecting portion 112 and the to-be-connected portion 122 changes from the gaps 135 when the process cartridge 30 is retreated to the gaps 134 when the process cartridge 30 is mounted in the image forming apparatus body 12 (see FIG. 4A, FIG. 4B, FIG. 5A, and FIG. 5B).

Along the movement of the column end portion 150 of the column portion 148, the spring member 152, which is disposed in the column portion 148, contracts and moves so as to apply pressure between the column end portion 150 and the process cartridge 30, so that the pressing force between the photoconductor 42 of the process cartridge 30 and the to-be-transferred member 52 are adjusted. After that, the opening and closing portion 104 is closed, and the mounting of the process cartridge 30 is finished.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier that is rotatably supported;

a to-be-transferred member onto which an image that is held by the image carrier is transferred;

a driving unit that is disposed on a first end portion of the image carrier in an axial direction of the image carrier and that causes the image carrier to rotate; and a retreat mechanism that causes a second end portion of the image carrier to be separated from the to-be-transferred member such that the second end portion is at a position lower than a position of the first end portion, while a connection between the image carrier and the driving unit is maintained, and thereafter causes the image carrier to retreat by disconnecting the image carrier and the driving unit from each other.

2. The image forming apparatus according to claim 1, wherein the driving unit is formed in a cylindrical shape, and wherein the first end portion of the image carrier is connected to the driving unit by being inserted into the driving unit.

3. The image forming apparatus according to claim 1, wherein a gear portion that has a plurality of first protrusions protruding in an outward radial direction with respect to the axial direction of the image carrier and a plurality of first grooves formed between the first protrusions is formed in the first end portion of the image carrier, wherein the driving unit includes an internal gear portion that has a plurality of second protrusions protruding in an inward radial direction with respect to an axial direction of the driving unit and a plurality of second grooves formed between the second protrusions, and wherein the gear portion formed in the first end portion of the image carrier is inserted into the internal gear portion of the driving unit.

4. The image forming apparatus according to claim 2, wherein a gap that allows the first end portion of the image carrier to be obliquely disposed in the driving unit is formed between the driving unit and the first end portion of the image carrier.

5. The image forming apparatus according to claim 1, wherein the retreat mechanism includes an operation portion that is to be operated and a column portion that supports the image carrier in an image forming apparatus body, and wherein the column portion is arranged in such a manner as to allow the image carrier to perform a repetitive motion between a mounting position and a retreat position.

6. The image forming apparatus according to claim 5, wherein the retreat position is a position where the second end portion of the image carrier is disposed in such a manner as to be oriented in a direction different from an axial direction of the driving unit.

* * * * *